US010136795B2

(12) United States Patent
Nowell, Jr. et al.

(10) Patent No.: US 10,136,795 B2
(45) Date of Patent: Nov. 27, 2018

(54) DISH RACK RETAINING CLIP

(71) Applicant: WHIRLPOOL CORPORATION, Benton Harbor, MI (US)

(72) Inventors: Ronald M. Nowell, Jr., St. Joseph, MI (US); Kapil Gupta, Jhansi (IN); Richard Lawrence Kretz, Findlay, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/426,345

(22) Filed: Feb. 7, 2017

(65) Prior Publication Data

US 2018/0220868 A1 Aug. 9, 2018

(51) Int. Cl.

| | |
|---|---|
| ***A47L 15/50*** | (2006.01) |
| *A47L 15/22* | (2006.01) |
| *A47L 15/16* | (2006.01) |

(52) U.S. Cl.

CPC ..... *A47L 15/504* (2013.01); *A47L 15/507* (2013.01); *A47L 15/16* (2013.01); *A47L 15/22* (2013.01); *A47L 15/502* (2013.01)

(58) Field of Classification Search

CPC .... A47L 15/504; A47L 15/507; A47L 15/502; A47L 15/503; A47L 15/505

See application file for complete search history.

(56) References Cited

U.S. PATENT DOCUMENTS

| | | | | |
|---|---|---|---|---|
| 3,726,581 | A * | 4/1973 | Doepke | A47L 15/504 312/311 |
| 5,474,378 | A * | 12/1995 | Smith | A47L 15/504 248/297.31 |
| 5,657,878 | A * | 8/1997 | Austin | A47L 15/504 211/208 |
| 5,860,716 | A * | 1/1999 | Good | A47L 15/504 312/311 |
| 6,974,040 | B2 * | 12/2005 | Jahrling | A47L 15/504 211/175 |
| 7,168,578 | B2 | 1/2007 | Mersch et al. | |
| 7,410,228 | B2 * | 8/2008 | Dickson | A47L 15/504 211/41.9 |
| 7,424,893 | B2 * | 9/2008 | Kim | A47L 15/504 134/137 |
| 7,775,378 | B2 * | 8/2010 | Tynes | A47L 15/504 211/41.8 |
| 8,534,471 | B2 * | 9/2013 | Wong | A47L 15/504 211/41.8 |
| 8,567,882 | B1 * | 10/2013 | Garnett | A47L 15/504 211/41.8 |

(Continued)

FOREIGN PATENT DOCUMENTS

| | | |
|---|---|---|
| EP | 0848930 A2 | 6/1998 |
| EP | 1310205 A1 | 5/2003 |

(Continued)

*Primary Examiner* — Kimberley S Wright

(74) *Attorney, Agent, or Firm* — McGarry Bair PC

(57) ABSTRACT

A dish rack assembly includes a dish rack having spaced wire frame elements at least partially defining a side wall, a height adjuster comprising an arm located on an exterior of the side wall and a retaining clip mounted to the arm and located on an interior of the side wall that can limit the relative movement of the dish rack.

19 Claims, 6 Drawing Sheets

(56) References Cited

U.S. PATENT DOCUMENTS

| | | | | |
|---|---|---|---|---|
| 8,757,742 | B2 * | 6/2014 | McDaniel | A47L 15/507 211/41.8 |
| 8,840,201 | B2 * | 9/2014 | Garnett | A47L 15/504 312/228.1 |
| 9,004,082 | B2 * | 4/2015 | Bhajak | A47L 15/504 134/135 |
| 9,113,773 | B2 * | 8/2015 | Bartloff | A47B 95/043 |
| 9,510,676 | B2 * | 12/2016 | Tarcy | A47B 57/06 |
| 9,579,009 | B2 * | 2/2017 | Bhajak | A47L 15/50 |
| 2003/0075517 | A1 * | 4/2003 | Jahrling | A47L 15/504 211/41.8 |
| 2004/0103932 | A1 * | 6/2004 | Kim | A47L 15/504 134/137 |
| 2006/0119236 | A1 * | 6/2006 | Dickson | A47L 15/504 312/311 |
| 2008/0272072 | A1 * | 11/2008 | Tynes | A47L 15/504 211/41.8 |
| 2012/0082507 | A1 * | 4/2012 | Wong | A47L 15/504 403/17 |
| 2014/0217868 | A1 * | 8/2014 | Bhajak | A47L 15/50 312/228.1 |
| 2016/0331204 | A1 * | 11/2016 | Kutto | A47L 15/504 |

FOREIGN PATENT DOCUMENTS

| | | | |
|---|---|---|---|
| EP | 1351599 | A1 | 10/2003 |
| EP | 1854394 | A1 | 11/2007 |
| KR | 20070008807 | A | 1/2007 |
| WO | 0249495 | A1 | 6/2002 |

* cited by examiner

DISH RACK RETAINING CLIP

BACKGROUND OF THE INVENTION

Contemporary automatic dishwashers for use in a typical household include a tub defining a treating chamber and a spraying system for recirculating liquid throughout the tub to remove soils from dishes and utensils. Upper and lower dish racks for holding dishes to be cleaned are typically provided within the treating chamber and mounted to the tub by extensible support rails. The dishwasher is generally provided with a door, pivotally mounted to the tub, that provides access to the treating chamber when the door is in the open position and also permits the upper and lower dish racks to extend from the treating chamber to the outside of the tub.

BRIEF DESCRIPTION OF THE INVENTION

A dish rack assembly including a dish rack having spaced wire frame elements at partially defining a side wall, a height adjuster comprising an arm located on an exterior of the side wall and having a first rib extending along a first lateral side of one of the wire frame elements, and a retaining clip mounted to the arm and located on an interior of the side wall and having a second rib extending along a second lateral side, opposite the first lateral side, of the one of the wire frame elements.

A dish rack assembly including a dish rack having spaced wire frame elements at partially defining a side wall, a height adjuster comprising an arm located on an exterior of the side wall having a first rib extending along a first lateral side of one of the wire frame elements, and a pair of retaining clips having a space between, mounted to the arm and located on an interior of the side wall and having a second rib extending along a second lateral side, opposite the first lateral side, of the one of the wire frame elements wherein the height adjuster is located within the space.

DESCRIPTION OF EMBODIMENTS OF THE INVENTION

Figure 1:
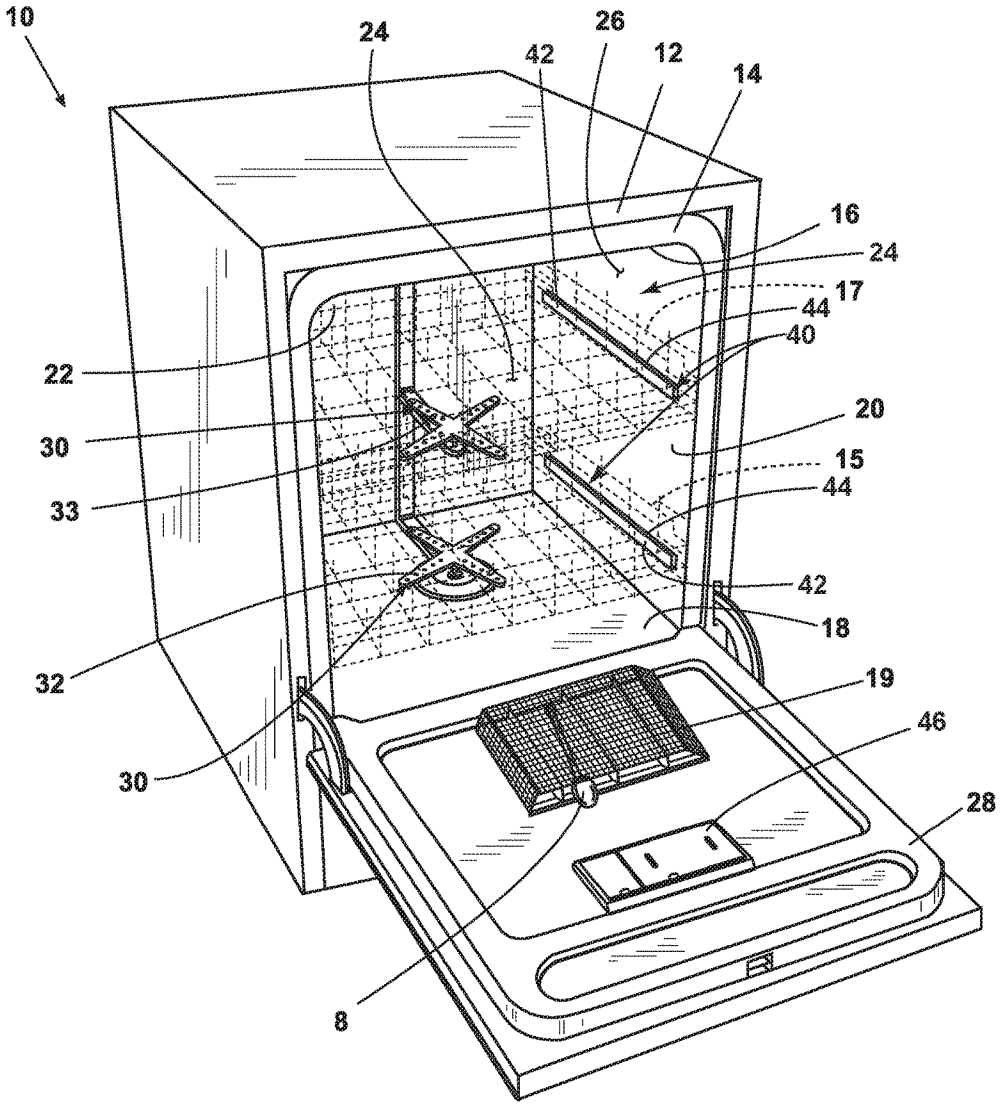
FIG. 1 is a perspective view of a first embodiment of a dishwasher having a tub with an opening, a moveable door, shown in an open condition, and multiple dish racks slidably mounted to the tub by drawer slides.

In FIG. 1, an automated dishwasher 10 according to one embodiment of the invention is illustrated. The dishwasher 10 can treat dishes according to an automatic cycle of operation. Depending on whether the dishwasher 10 is a stand-alone or built-in, a cabinet 12 of the dishwasher 10 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A tub 14 is disposed within the cabinet 12 and has spaced top and bottom walls 16 and 18, spaced side walls 20, and a rear wall 22. The walls 16, 18, 20, and 22 join along their respective edges to define a treating chamber 24 with an access opening 26. Utensil holders, or a dish rack assembly, in the form of upper and lower dish racks 15, 17 are located within the treating chamber 24 and receive utensils for washing. The dish racks 15, 17 are typically mounted to side walls 20 for slidable movement in and out of the treating chamber 24 for ease of loading and unloading and can be in the form of a wire-frame. The dish racks 15, 17 can be mounted with a guide rail assembly 40. The guide rail assembly 40 can include at least two guide rails. At least one of the guide rails, the guide rail mount 42, can be snapped to or otherwise mounted to the upper and lower dish racks 15, 17 as illustrated. The guide rail mount 42 can include, but is not limited to, an adjustable rack arm. The other of the guide rails is a guide rail track 44 that is mounted to the tub 14 along the side walls 20. The position of the guide rail mount 42 and the guide rail track 44 can be on one or the other of the upper and lower dish racks 15, 17 or the side walls 20. Any combination of the guide rail mount 42 and guide rail track 44 are contemplated.

Another utensil holder in the form of a silverware basket 19 is located on the door 28. The silverware basket 19 can be removably mounted to the door. Utensil holders 15, 17 and 19 all hold various utensils for washing within the treating chamber. As used in this description, the term utensil is generic to dishes and the like that are washed in the dishwasher 10 and expressly includes, dishes, plates, bowls, silverware, glassware, stemware, pots, pans, and the like A utensil, in the form of a spoon 8, is shown located in the silverware basket 19.

A door 28 is hingedly mounted to the dishwasher 10 and can move between an opened position, as illustrated in FIG. 1, to provide access to the treating chamber 24 and a closed position to close the treating chamber 24 by covering the access opening 26 of the treating chamber 24. Typically, the door 28 is in the opened position when utensils are loaded or unloaded into the dishwasher 10 and in the closed position while the washing cycle is running or while the dishwasher 10 is not in use. A bulk wash aid dispenser 46 is mounted on an inside surface of the door 28 such that the bulk wash aid dispenser 46 is disposed in the treating chamber 24 when the door 28 is in the closed position.

Additionally, the dishwasher 10 comprises a liquid circulation system 30 for introducing and circulating liquid and wash aids, such as detergents, rinse aids, and the like, throughout the treating chamber 24. The liquid circulation system comprises a pump located in a lower portion or sump of the tub 14 and which pumps liquid to sprayers 32 and 33. Sprayers 32, 33 are located, respectively, beneath lower rack 15 and upper rack 17 and are illustrated as rotating spray arms. Another sprayer can be located above the upper rack 17 and is illustrated as a fixed spray nozzle.

While "a set of" or "a pair of" various elements will be described, it will be understood that "a set" or "a pair" can include any number of the respective elements, including only one element. Additionally, all directional references (e.g., radial, axial, upper, lower, upward, downward, left, right, lateral, front, back, top, bottom, above, below, vertical, horizontal, clockwise, counterclockwise) are only used for identification purposes to aid the reader's understanding of the disclosure, and do not create limitations, particularly as to the position, orientation, or use thereof. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order, and relative sizes reflected in the drawings attached hereto can vary.

Figure 2:
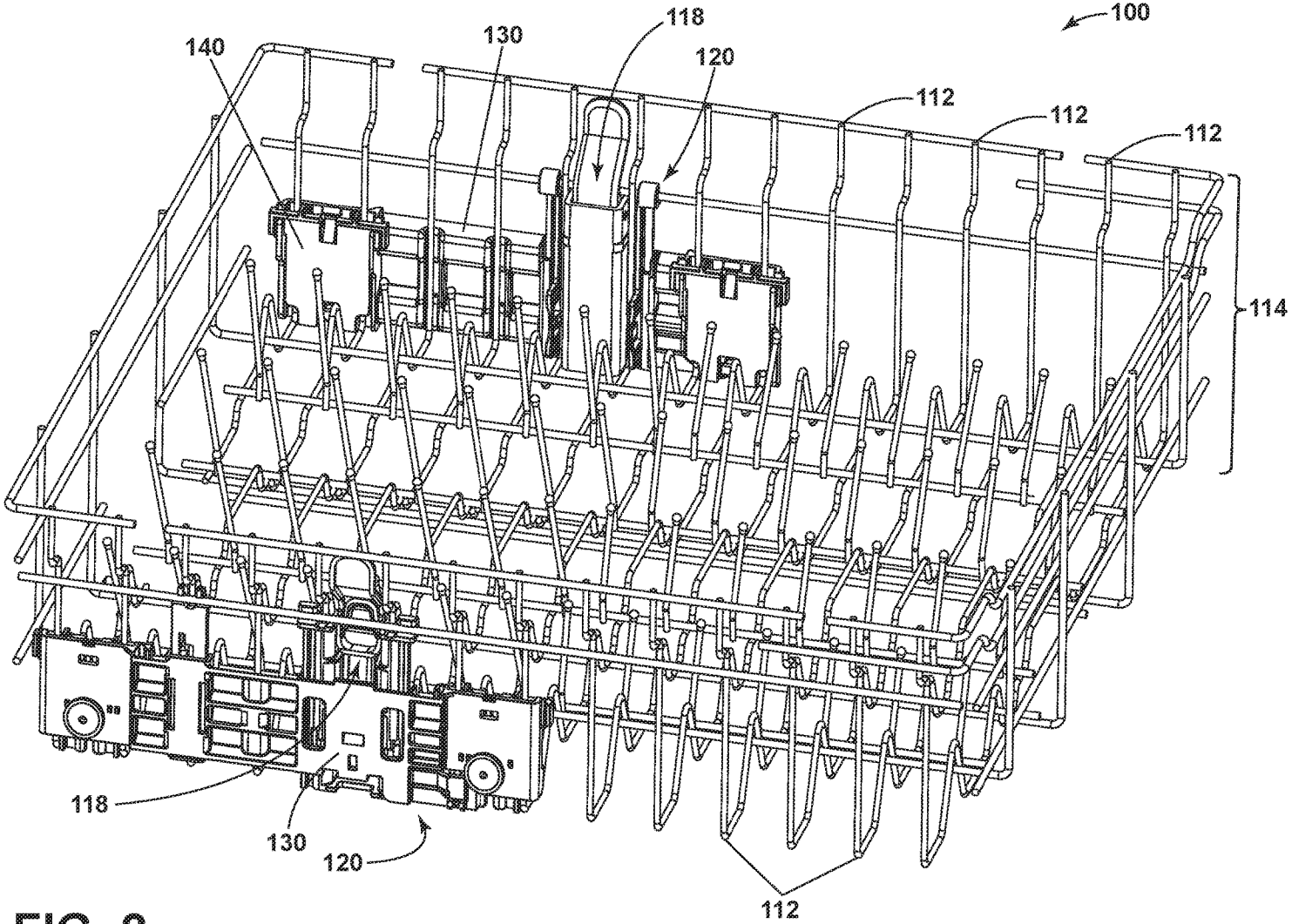
FIG. 2 is a dish rack with a height adjuster according to an embodiment of the invention.

FIG. 2 is a dish rack 100 according to an embodiment of the invention. The dish rack 100 can have a plurality of spaced wire frame elements 112. The wire frame elements 112 can be arranged to at least partially define a side wall 114. The exterior of the side wall 114 can confront a side wall 20 of the treating chamber 24, while the interior of the side wall 114 can confront utensils within the dish rack 100. The wire frame elements 112 can be made of metal or any other suitable material and can also include a coating such as a plastic coating to provide cushioning or corrosion resistance.

A height adjuster 120 having an arm 130, a retaining clip 140, and a height adjusting lever 118 can be provided on the side wall 114. The height adjuster 120 can be mounted to the side wall 114 and can adjust the height of the dish rack 100 within the treating chamber 24 with respect to the side wall 20. In the case that the dish rack 100 is an upper dish rack, the dish rack 100 can be raised in order to fit taller utensils on a lower dish rack, or lowered to fit taller utensils on the upper dish rack 100. One or more of the retaining clips 140 selectively mount to the arm 130 and are located on an interior of the side wall 114 while the arm 130 is located on the exterior of the side wall 114. The retaining clip 140 can be made of plastic, metal, a combination of plastic and metal, or any other suitable material. The retaining clips 140 cooperate with the arm 130 to mount the height adjuster 120 to the side wall 114 by constraining a portion of the wire frame elements 112 between the clips 140 and the arm 130.

Figure 3:
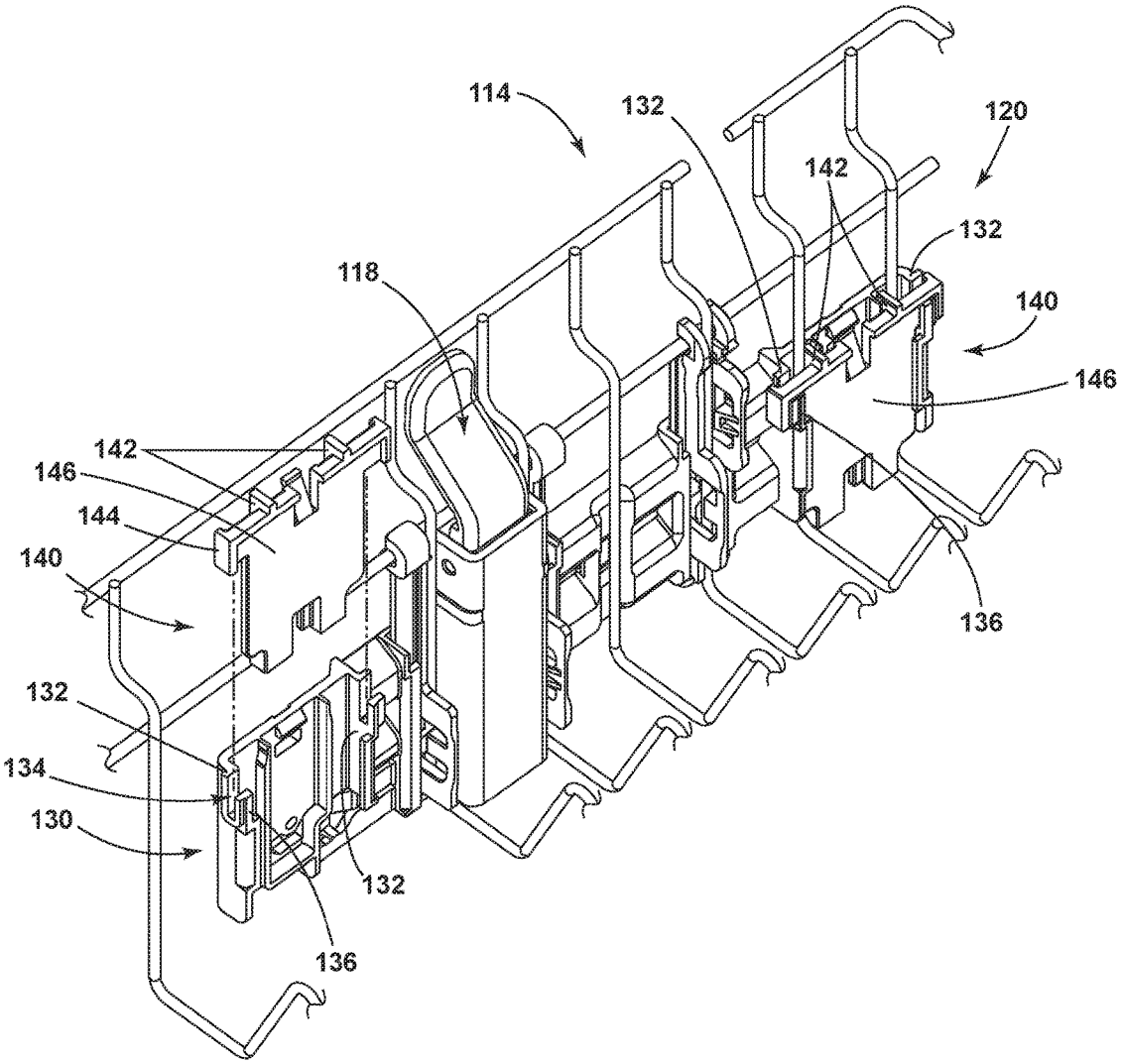
FIG. 3 is an exploded partial perspective view of the height adjuster in FIG. 2.

FIG. 3 is an exploded partial perspective view of the height adjuster 120 in FIG. 2. A pair of spaced first ribs 132 can be provided on the arm 130 and a pair of spaced second ribs 142 can be provided on the retaining clip 140. The height adjuster 120 can include multiple sets of pairs of first ribs 132 and retaining clips 140. FIG. 3 illustrates the height adjuster 120 having two pairs of first ribs 132 and two retaining clips 140, laterally spaced along the arm 130 of the height adjuster 120. The height adjusting lever 118 can be located in the space between the set of retaining clips 140. While the height adjusting lever 118 is shown between the set of retaining clips 140, it is possible that the height adjusting lever 118 be adjacent to only one retaining clip 140.

A first guide 136, shown in the form of a hook 136, can be provided on the arm 130 and interiorly spaced from the arm 130 such that the hook 136 is closer to the interior of the dish rack 100 than the arm 130. The hook 136 can extend from the first rib 132. A second guide, shown in the form of a planar body 146, can be provided on the clip 140. In order to fix the relative position of the arm 130 and the retaining clip 140, a first stop 134 can be provided on one of the arm 130 and the retaining clip 140 and a second stop 144 can be provided on the other of the arm 130 and the retaining clip 140. The first stop 134 can be in the form of a channel 134 and the second stop 144 can be in the form of a flange 144 slidably received within the channel 134. To couple the retaining clip 140 to the arm 130, the retaining clip 140 can be slid downwards such that the channel 134 receives the flange 144 and the planar body 146 is disposed between the hooks 136.

Figure 4:
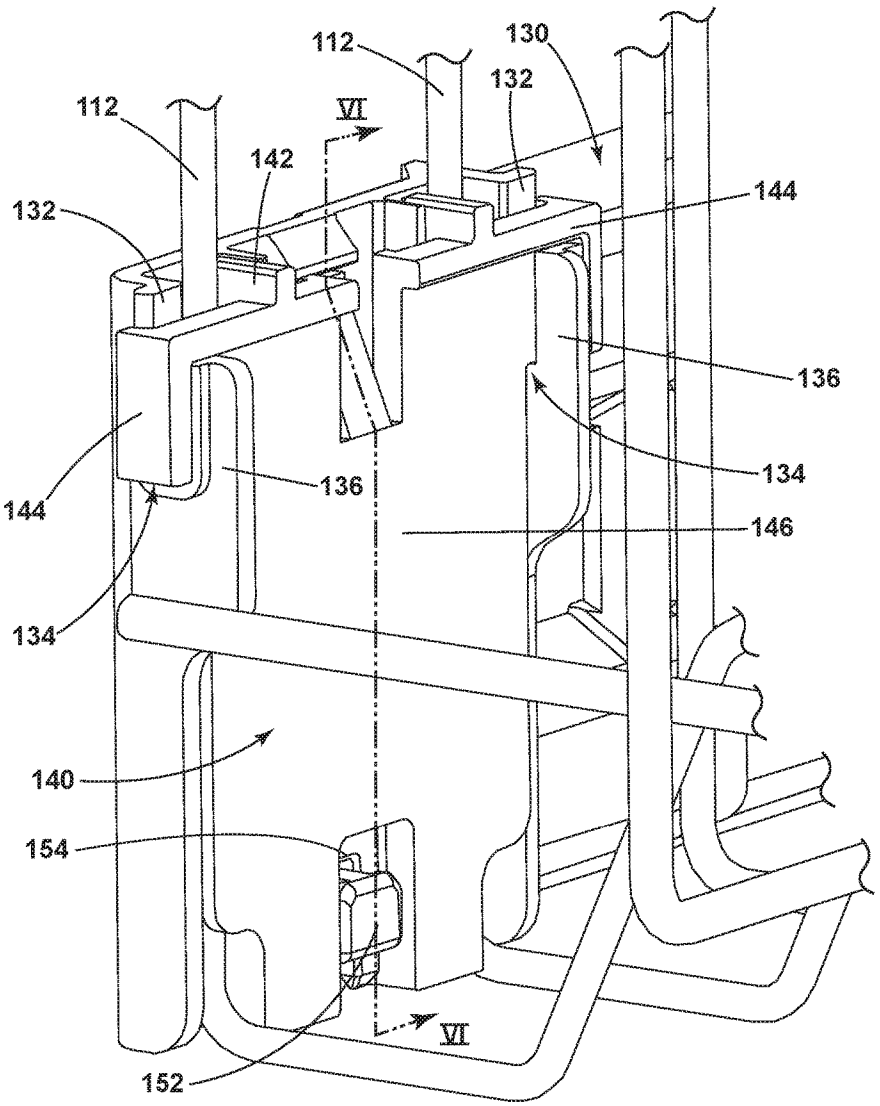
FIG. 4 is an enlarged perspective view of the retaining clip in FIG. 3.

FIG. 4 is an enlarged view of the coupled retaining clip 140 in FIG. 3. When the retaining clip 140 is coupled to the arm 130, the first rib 132 can extend along a first lateral side of one of the wire frame elements 112, while the second rib 142 can extend along a second lateral side, opposite the first lateral side of the wire frame element 112. Thus, the wire frame element 112 can be between the first rib 132 and second rib 142. The pair of first ribs 132 can extend along a different wire frame element 112 the a pair of spaced second ribs 142, each second rib 142 complementary to one of the first ribs 132, can extend along a different wire frame element 112 such that each complementary pair of first ribs 132 and second ribs 142 are on laterally opposite sides of the corresponding wire frame element 112.

Additionally, a third stop 152 and a fourth stop 154 can be included on one of the arm 130 and the retaining clip 140 in order to provide a secondary mechanism to fix the relative position of the arm 130 and the retaining clip 140. The third stop 152 can be in the form of a protrusion 152 provided on the arm 130 and the fourth stop 154 can be in the form of a recess 154 in the planar body 146 of the clip 140 such that the protrusion 152 is slidably received within the recess 154.

Figure 5:
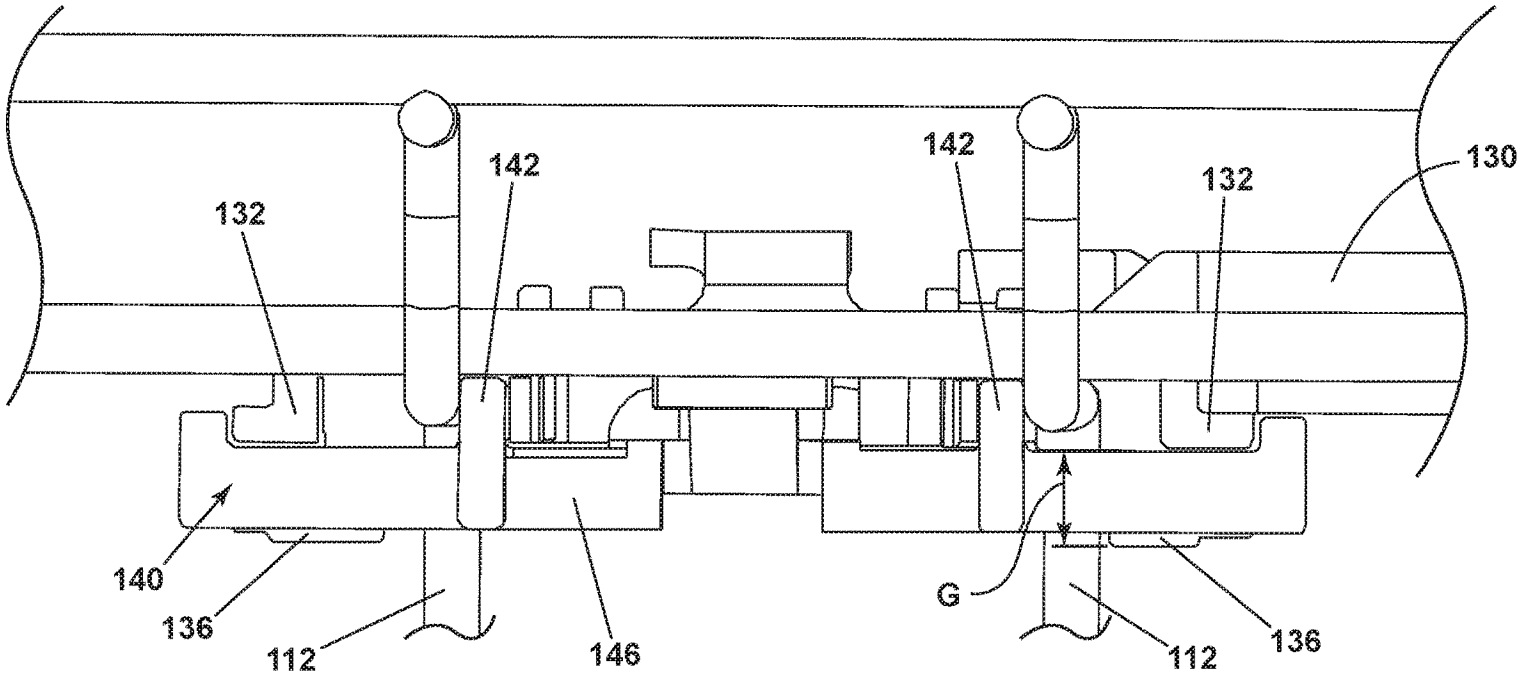
FIG. 5 is a top view of the retaining clip in FIG. 4.

FIG. 5 is a top view of the retaining clip in FIG. 4. A gap G can be defined by the distance, or space between the hook 136 and the first rib 132. The planar body 146 can be received within the gap G when the retaining clip 140 is slid downwards to couple the retaining clip 140 to the arm 130.

Figure 6:
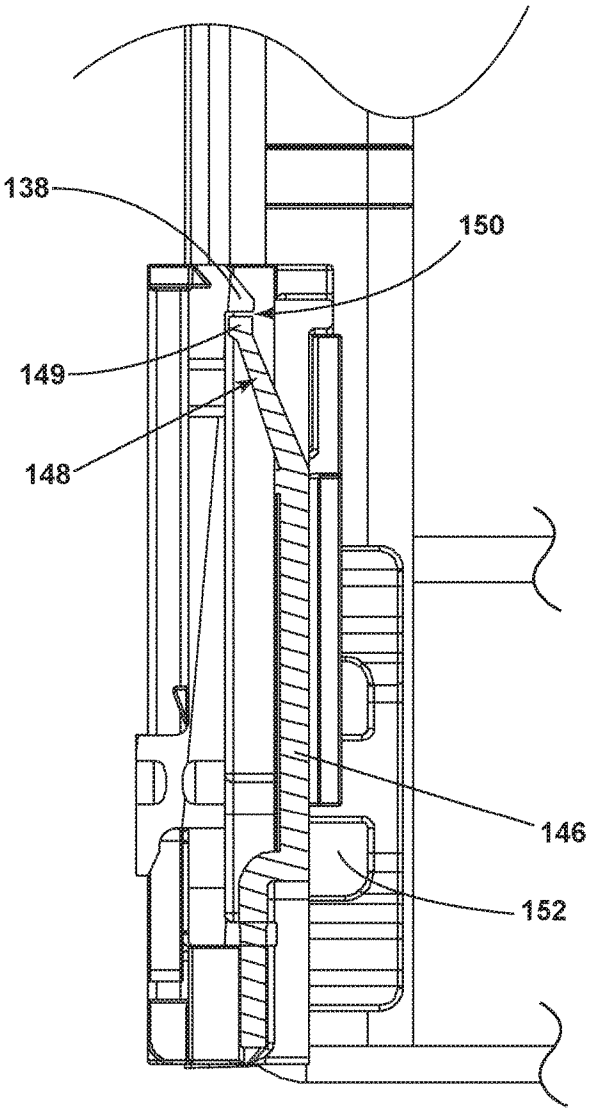
FIG. 6 is a cross-sectional view along line VI-VI in FIG. 4.

FIG. 6 is a cross-sectional view along line VI-VI in FIG. 3. Another mechanism to fix the relative movement of the arm 130 and the retaining clip 140 can be in the form of a catch 138 provided on one of the arm 130 and the retaining clip 140 and a strike 148 provided on the other of the arm 130 and the retaining clip 140. The catch 138 can include an opening 150 and the strike 148 can include a spring finger 149 received within the opening 150 to prevent vertical movement of the clip 140. However, the strike 148 and catch 138 can be in the form of any suitable geometry to fix the relative movement of the arm 130 and the retaining clip 140.

In order to couple the retaining clip 140 to the arm 130, a user can align the clip 140 with the gap G and insert the clip 140 such that the flange 144 slides down and within the channel 134. Likewise, the protrusion 152 is received within the recess 154. As the clip 140 is slid down the spring finger 149 on the strike 148 can flex and slide over the catch 138 through the opening 150. When the flange 144 to abuts the channel 134 the spring finger 149 has slid over the catch 138 and flexes back so that the spring finger 149 is positioned below the catch 138 and upward movement is prevented. The planar body 146 can be disposed between the hooks 136 and first ribs 132 such that the wire frame elements 112 are sandwiched between the clip 140 and the arm 130.

The aspects of the disclosure described herein can be used to limit movement of a dish rack in a dishwasher, ensuring that the dish rack has decreased lateral and vertical movement. Aspects of the disclosure can be used to avoid the undesirable circumstances when a dish rack is jostled and dishes within the dish rack to clang together, thus avoiding possible damage to the dishes. It will be understood that while the aspects of the disclosure described herein are shown in the context of a dishwasher, the aspects of the disclosure can be utilized to limit movement for components of any household appliance.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dish rack assembly, comprising:

a dish rack having spaced wire frame elements at least partially defining a dish rack side wall and configured to retain dishes;

a height adjuster comprising an arm located on an exterior of the dish rack side wall having a pair of spaced first ribs extending therefrom with each of the pair of spaced first ribs extending along a different wire frame element, the height adjust further including a lever and wherein the arm is configured to be operably coupled to a tub side wall and the lever is configured to move the arm vertically to adjust the height of the dish rack with respect to the tub side wall; and a retaining clip located on an interior of the dish rack side wall and having a planar body with a pair of second ribs extending therefrom, each of the pair of second ribs is complementary to each of the pair of first ribs;

wherein the retaining clip is mounted to the arm such that a first of the pair of first ribs and a first of the pair of second ribs are directly adjacent opposite lateral sides of a first of the spaced wire frame elements and the arm and retaining clip are on opposite sides, transverse to the lateral sides, of the first of the spaced wire frame elements and a second of the pair of first ribs and a second of the pair of second ribs are directly adjacent opposite lateral sides of a second of the spaced wire frame elements and the arm and retaining clip are on opposite sides, transverse to the lateral sides, of the second of the spaced wire frame elements.

2. The dish rack assembly of claim 1 wherein one of the arm and retaining clip comprises a first stop and a second stop to fix the relative position of the arm and the retaining clip.

3. The dish rack assembly of claim 2 wherein the first stop comprises a channel and the second stop comprises a flange slidably received within the channel.

4. The dish rack assembly of claim 3 wherein the arm comprises a first guide interiorly spaced from the one of the wire frame elements to define a gap.

5. The dish rack assembly of claim 4 wherein the retaining clip comprises a second guide slidably received within the gap.

6. The dish rack assembly of claim 5 wherein the second guide comprises a planar body.

7. The dish rack assembly of claim 5 wherein the first guide comprises a hook extending from the first rib.

8. The dish rack assembly of claim 1 further comprising a catch provided on one of the arm and retaining clip and a strike provided on the other of the arm and retaining clip, with the catch and strike cooperating to fix the relative movement of the arm and the retaining clip.

9. The dish rack assembly of claim 8 wherein the catch comprises an opening and the strike comprises a spring finger received within the opening.

10. The dish rack assembly of claim 1, further comprising multiple pairs of first ribs and retaining clips.

11. The dish rack assembly of claim 1 wherein the arm includes an upwardly extending slot configured to receive a portion of the clip when the clip is slid downwards therein.

12. The dish rack assembly of claim 11 wherein the arm includes two upwardly extending slots configured to receive corresponding portions of the retaining clip.

13. The dish rack assembly of claim 11 wherein the slot is formed by a hook spaced from a remainder of the arm.

14. A dish rack assembly, comprising:

a dish rack having spaced wire frame elements at least partially defining a dish rack side wall, the dish rack configured to retain dishes;

a height adjuster comprising an arm located on an exterior of the dish rack side wall, the arm including a first rib extending therefrom, the height adjust further including a lever and wherein the arm is configured to be operably coupled to a tub side wall and the lever is configured to move the arm vertically to adjust the height of the dish rack with respect to the tub side wall; and a pair of retaining clips having a space between the pair of retaining clips and where the pair of retaining clips are located on an interior of the dish rack side wall and each of the pair of retaining clips having a planar body with a second rib extending therefrom;

wherein each of the pair of retaining clips is mounted to the arm such that the first and second ribs are on opposite lateral sides of one of the wire frame elements and the arm and each of the pair of retaining clips are on opposite sides, transverse to the lateral sides, of the one of the wire frame elements and the lever is located within the space between the pair of retaining clips.

15. The dish rack assembly of claim 14 wherein the arm comprises a pair of spaced first ribs, with each first rib extending along a different wire frame element, and the retaining clips have a pair of second ribs, each second complementary to one of the first ribs and extending along a different wire frame element such that each complementary pair of first and second ribs are on laterally opposite sides of the corresponding wire frame element.

16. The dish rack assembly of claim 15 wherein one of the arm and retaining clip comprises a first stop and a second stop to fix the relative position of the arm and the retaining clip.

17. The dish rack assembly of claim 16 wherein the first stop comprises a channel and the second stop comprises a flange slidably received within the channel.

18. The dish rack assembly of claim 14, further comprising a catch provided on one of the arm and retaining clip and a strike provided on the other of the arm and retaining clip, with the catch and strike cooperating to fix the relative movement of the arm and the retaining clip.

19. The dish rack assembly of claim 18 wherein the catch comprises an opening and the strike comprises a spring finger received within the opening.

* * * * *